US009028282B2

(12) United States Patent
Li et al.

(10) Patent No.: US 9,028,282 B2
(45) Date of Patent: May 12, 2015

(54) LOWER PROFILE CARD EDGE CONNECTOR

(71) Applicant: Hon Hai Precision Industry Co., Ltd., New Taipei (TW)

(72) Inventors: Hua Li, Kunshan (CN); Zhen-Hua Wang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 14/093,029

(22) Filed: Nov. 28, 2013

(65) Prior Publication Data

US 2014/0148060 A1 May 29, 2014

(30) Foreign Application Priority Data

Nov. 29, 2012 (CN) ..... 2012 2 0643514

(51) Int. Cl.
*H01R 13/40* (2006.01)
*H01R 13/405* (2006.01)
*H01R 12/72* (2011.01)

(52) U.S. Cl.
CPC ..... *H01R 13/405* (2013.01); *H01R 12/721* (2013.01); *H01R 12/724* (2013.01)

(58) Field of Classification Search
CPC ..... H01R 13/41; H01R 13/5216
USPC ..... 439/733.1, 936, 595, 328
See application file for complete search history.

(56) References Cited

U.S. PATENT DOCUMENTS

2008/0227328 A1* 9/2008 Ju ..... 439/376
2009/0001532 A1* 1/2009 Shiomi ..... 257/675
2009/0191731 A1* 7/2009 Lemke et al. ..... 439/83
2010/0311253 A1* 12/2010 Lee et al. ..... 439/65
2014/0315442 A1* 10/2014 Liu et al. ..... 439/629

FOREIGN PATENT DOCUMENTS

CN 202217811 U 5/2012
CN 202363640 U 8/2012

* cited by examiner

*Primary Examiner* — Phuongchi T Nguyen
(74) *Attorney, Agent, or Firm* — Wei Te Chung; Ming Chieh Chang

(57) ABSTRACT

A card edge connector includes an insulative housing defining a central slot extending forwardly, a first wall and a second wall located on the opposite sides of the central slot and a rear wall connecting the first and second walls. The first wall defines an inner surface, a mounting surface opposite to the inner surface and a plurality of first terminal slots running through the inner surface and the mounting surface, the second wall defines a plurality of second terminal slots. A plurality of first terminals are received in the first terminal slots and includes first retaining portions retained in the first terminal slots. A plurality of second terminals are received in the second terminal slots. The mounting surface defines a recess close to the first retaining portions, a longitudinal plastic sheet is received in recess and melted to fix the first retaining portions to the first wall.

20 Claims, 8 Drawing Sheets

LOWER PROFILE CARD EDGE CONNECTOR

BACKGROUND OF THE INVENTION

1. Field of the Invention

The present invention relates to a card edge connector, and more particularly to a lower profile card edge connector having a plastic sheet used for retaining a row of lower terminals. The instant application relates to a copending application Ser. No. 14/070,581 filed Nov. 4, 2013 having the same applicant therewith.

2. Description of the Related Art

Chinese Utility Pat. No. 202217811U issued on May 9, 2012, discloses a card edge connector including an insulative housing, a row of first terminals and a row of second terminals. A first elastic portion of the first terminal extends forwardly from a first retaining portion to a first contacting portion without folding and a second elastic portion of the second terminal extends forwardly from a second retaining portion to a second contacting portion without folding. The elastic portions of the first and second terminals extends forwardly along a non-back folding line so that it can effectively reduce height of the first and second terminals which can synchronously reduce the thickness of the card edge connector.

However, the height of the connector is desired to be lower and lower in nowadays, therefore, an improved card edge connector is highly desired to meet overcome the requirement.

BRIEF SUMMARY OF THE INVENTION

An object of the present invention is to provide a lower profile card edge connector.

In order to achieve above-mentioned object, a card edge connector includes an insulative housing defining a central slot extending along a longitudinal direction thereof and running through a front face thereof, a first wall and a second wall located on the opposite sides of the central slot and a rear wall connecting the first and second walls. The first wall defines an inner surface facing to the central slot, a mounting surface opposite to the inner surface and a plurality of first terminal slots arranged along the longitudinal direction and running through the inner surface and the mounting surface. The second wall defines a plurality of second terminal slots arranged along the longitudinal direction. A plurality of first terminals are received in the first terminal slots and include first retaining portions retained in the first terminal slot. A plurality of second terminals are received in the second terminal slots. The mounting surface defines a recess corresponding to and close to the first retaining portions, and a longitudinal plastic sheet is received in recess and melted to fix the first retaining portions to the first wall.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
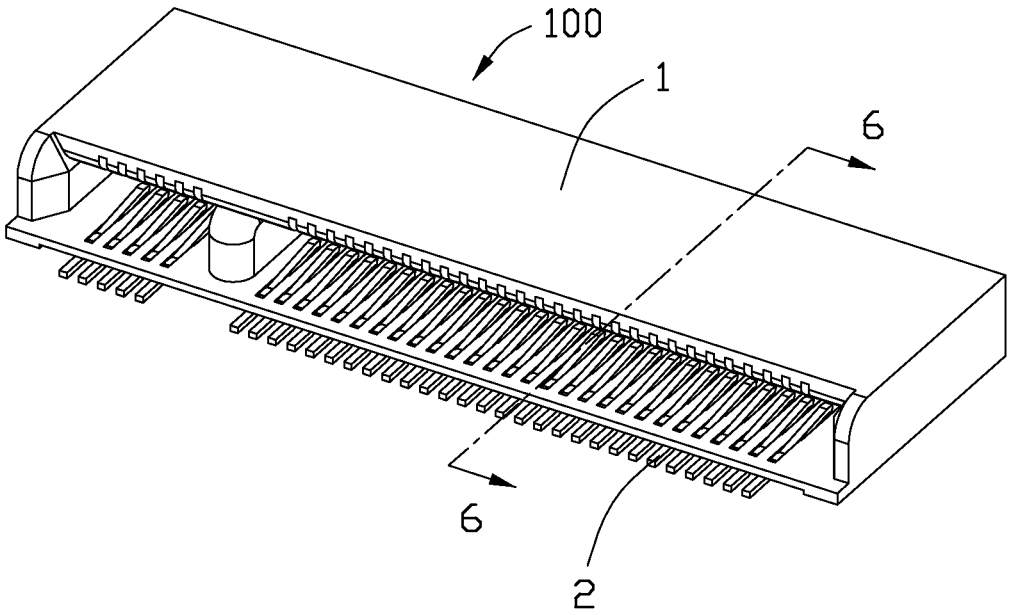
FIG. 1 is a perspective view of a card edge connector in accordance with the present invention in a first embodiment.
Figure 2:
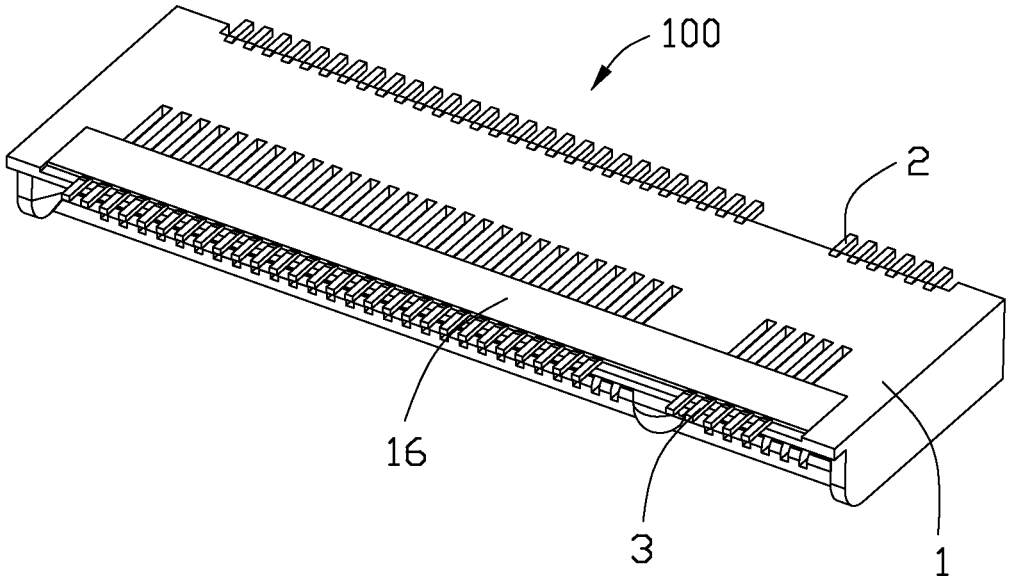
FIG. 2 is another perspective view similar to FIG. 1.

Reference will now be made to the drawing figures to describe a preferred embodiment of the present invention in detail. FIGS. 1 to 2 discloses a card edge connector 100 in accordance with in a first embodiment of the present invention. Referring to FIGS. 1 to 2, the card edge connector 100 for accommodating an electrical card is used to be soldered on a motherboard of an electronic device in order to achieve the electronic transmission between the electrical card and the motherboard. This electronic device can be thinner laptop or other similar electronic products. The card edge connector 100 includes an insulative housing 1, a plurality of first terminals 2 in a front lower row and a plurality of second terminals 3 in a rear upper row accommodated in the insulative housing 1.

Figure 3:
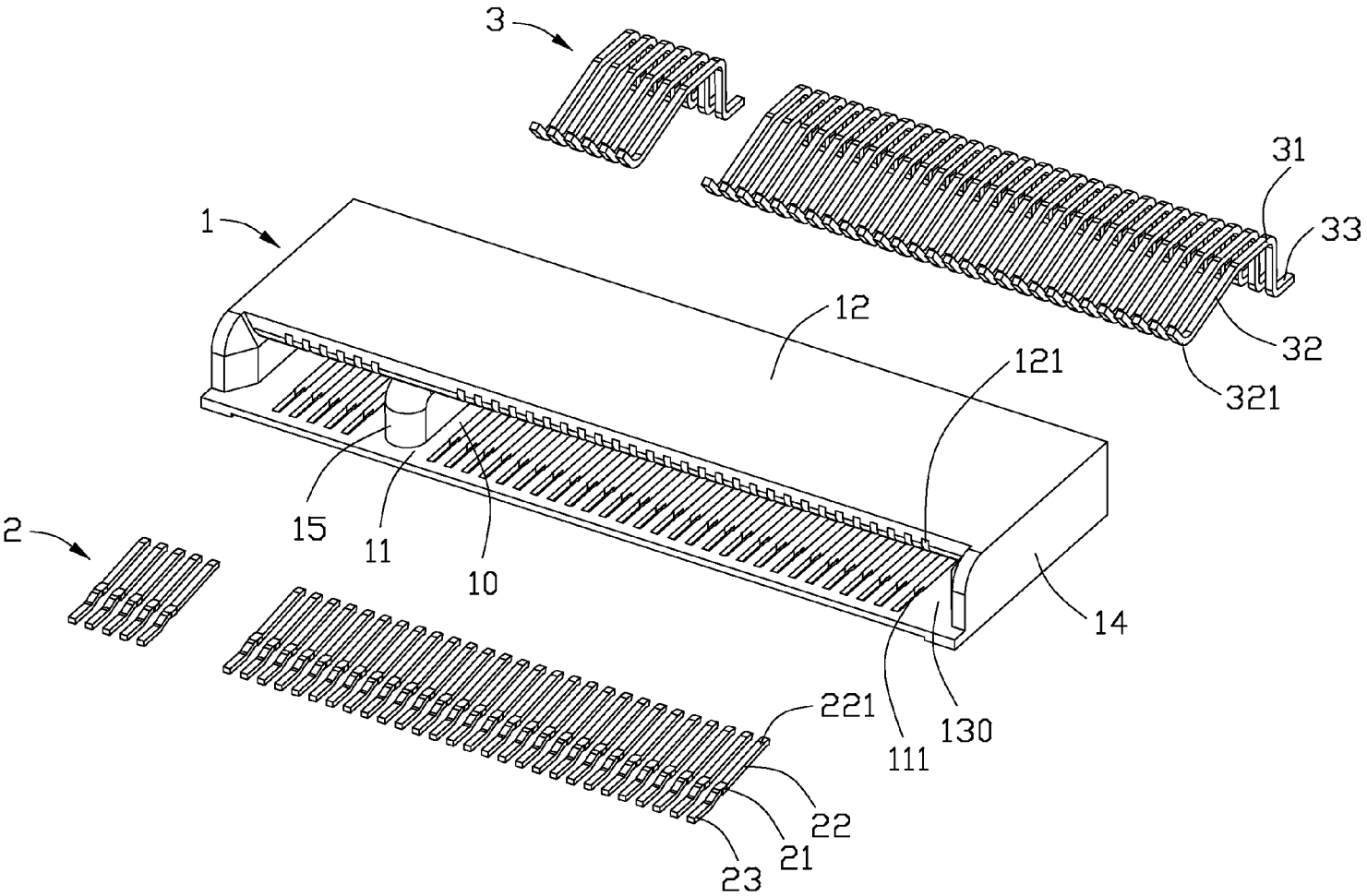
FIG. 3 is an exploded perspective view of the card edge connector shown in FIG. 1.
Figure 4:
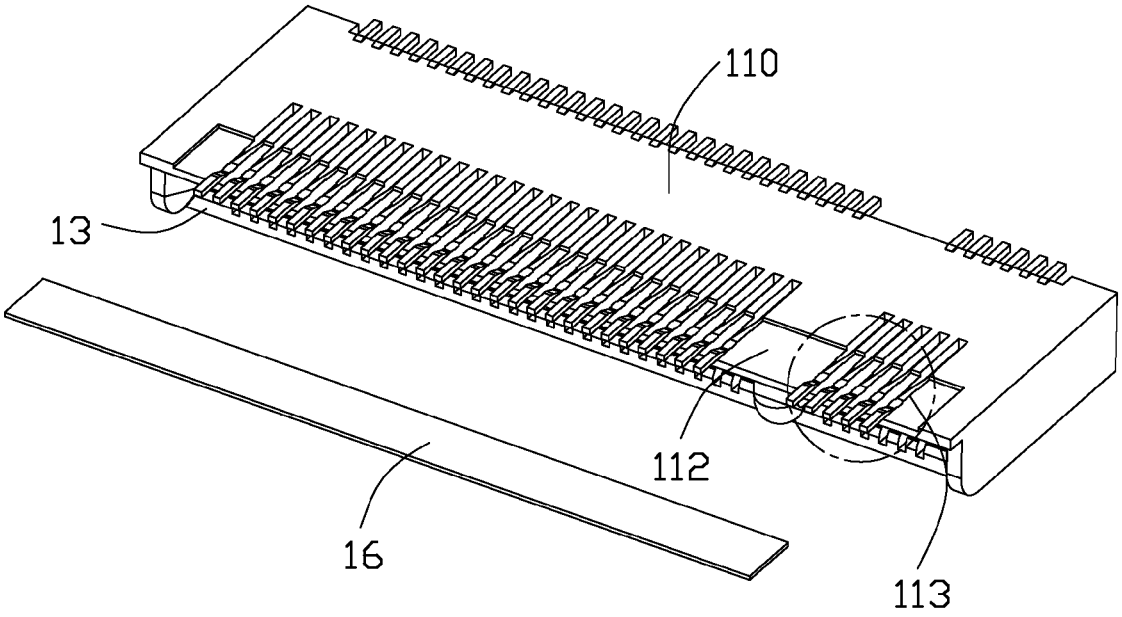
FIG. 4 is a partially exploded perspective view of the card edge connector shown in FIG. 2, showing a plastic sheet separated from a housing of the card edge connector.
Figure 5:
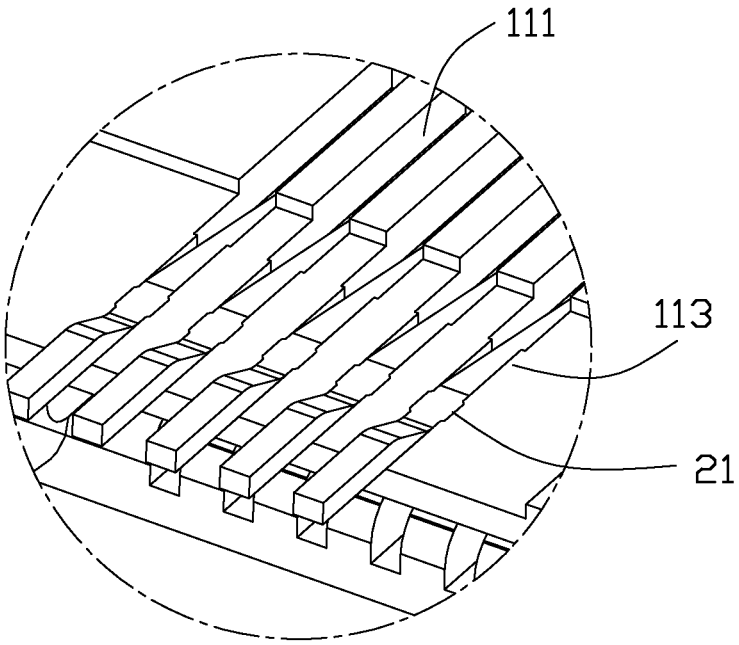
FIG. 5 is a partially enlarged view shown in a circle portion of the card edge connector of FIG. 4.
Figure 6:
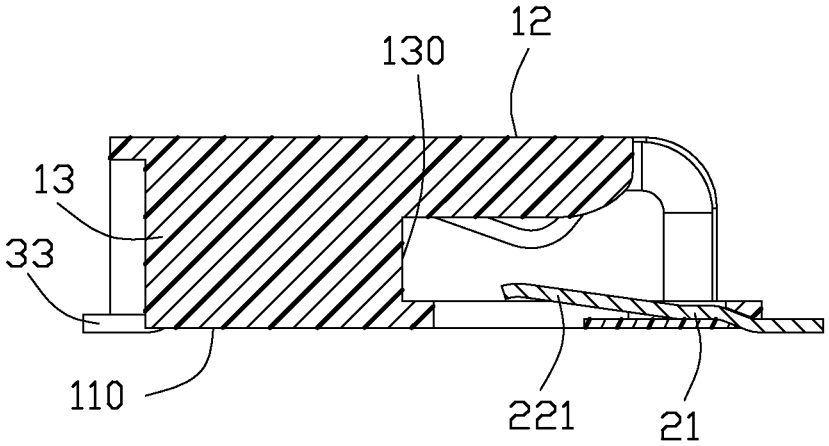
FIG. 6 is a sectional view of the card edge connector along line 6-6 shown in FIG. 1.

Referring to FIGS. 3 to 5, the insulative housing 1 is elongated shape and comprises a first wall 11 and a second wall 12 opposite to each other, a rear wall 13 connecting to the first wall 11 and the second wall 12, and a pair of side walls 14 respectively located on two longitudinal ends of the first and second walls 11, 12. A narrow central slot 10 extends along a longitudinal direction of the connector is located between the first wall 11 and the second wall 12 for receiving the electrical card, and the central slot 10 defines a key 15 close to one of the side walls 14 to prevent the electrical card from being inserted into the central slot 10 in an incorrect direction. Said three walls commonly define an inner surface 130 facing to the central slot 10 and the first wall defines a mounting surface 110 for mounting onto the motherboard opposite to the inner surface 130 of the first wall 11, the second wall 12 is far away from the mounting surface 110, and the first and second walls 11, 12 are located at opposite sides of the central slot 10. In a front-to-rear direction, the first wall 11 forwardly projects beyond the second wall 12, which means that the length of the first wall 11 is different from the length of the second wall 12 in the front-to-rear direction so as to form an obliquely upward insertion port in the front of the central slot 10 to facilitate the obliquely insertion of the electrical card.

The first wall 11 defines a plurality of first terminal slots 111 opening to the central slot 10, and the second wall 12 defines a plurality of second terminal slots 121 opening to the central slot 10 and each offsets from a corresponding first terminal slot 111 in the longitudinal direction. Each second terminal slot 121 communicates with the central slot 10 and runs through the rear wall 13 to form a fixing slot therein. Each first terminal slot 11 runs though the inner surface 130 and the mounting surface 110 of the first wall 11, which can reduce the thickness of the first wall 11, thereby reducing the entire height of the card edge connector 100.

The plurality of first terminals 2 are assembled into the first terminal slots 111 from the mounting surface 110 of the first wall 11. Each first terminal 2 defines a first retaining portion 21 received in the insulative housing 1, a first contacting arm 22 extending slantwise and rearwardly from the first retaining portion 21 and a first soldering portion 23 extending forwardly from the first retaining portion 21. The first contacting arm 22 has a first contacting portion 221 projecting into the central slot 10. Each first terminal slot 111 defines two inward-projecting portions 113 facing to each other at a front portion thereof, which makes the width of the front end of the first terminal slot 111 is smaller than the width of its rear end. The width of the first retaining portion 21 of the first terminal 2 is wider than the width of first contacting arm 22. When the first terminal 2 is inserted into the first terminal slot 111, the first retaining portion 21 may engage with the projecting portions 113 of the first terminal slot 111 to form preliminary retention and position. The mounting surface 110 of the first wall 11 defines a recess 112 corresponding to the first retaining portion 21, and a longitudinal plastic sheet 16 can be set into the recess 112 and to be melted to fix the first retaining portions 21 to the first wall 11, and the plastic sheet 16 does not extend beyond the front surface of the first wall 11.

The plurality of second terminals 3 are assembled into the second terminal slots 121 of the second wall 12 from the rear wall 13 in a rear-to-front direction. Each second terminal 3 defines a second retaining portion 31 received in the fixing slot, a second contacting arm 32 bending and extending forwardly from the second retaining portion 31 and a second soldering portion 33 extending rearwardly from the second retaining portion 31. The second contacting arm 32 is resilient and has a second contacting portion 221 projecting into the central slot 10, the second soldering portion 33 rearwardly extends outside of the insulative housing 1 for locating on the motherboard.

The first terminal 2 can be elastic deformed to downwardly move in the first terminal slot 111 when the electrical card is inserted into the central slot 10. The first terminal slot 111 runs through the mounting surface 110 of the first wall 11 and the first retaining portion 21 of the first terminal 2 is received in the first terminal slot 111 and retained in the first wall 11 by the melted plastic sheet 16, which can reduce the thickness of the first wall 11 so that the height of the card edge connector 100 is reduced. The total thickness of card edge connector 100 is not more than 2.25 mm so that the card edge connector 100 is adapted for miniaturization trends. The first contacting arm 22 of the first terminal 2 can be pressed to reach to the plane of the mounting surface 110.

Figure 7:
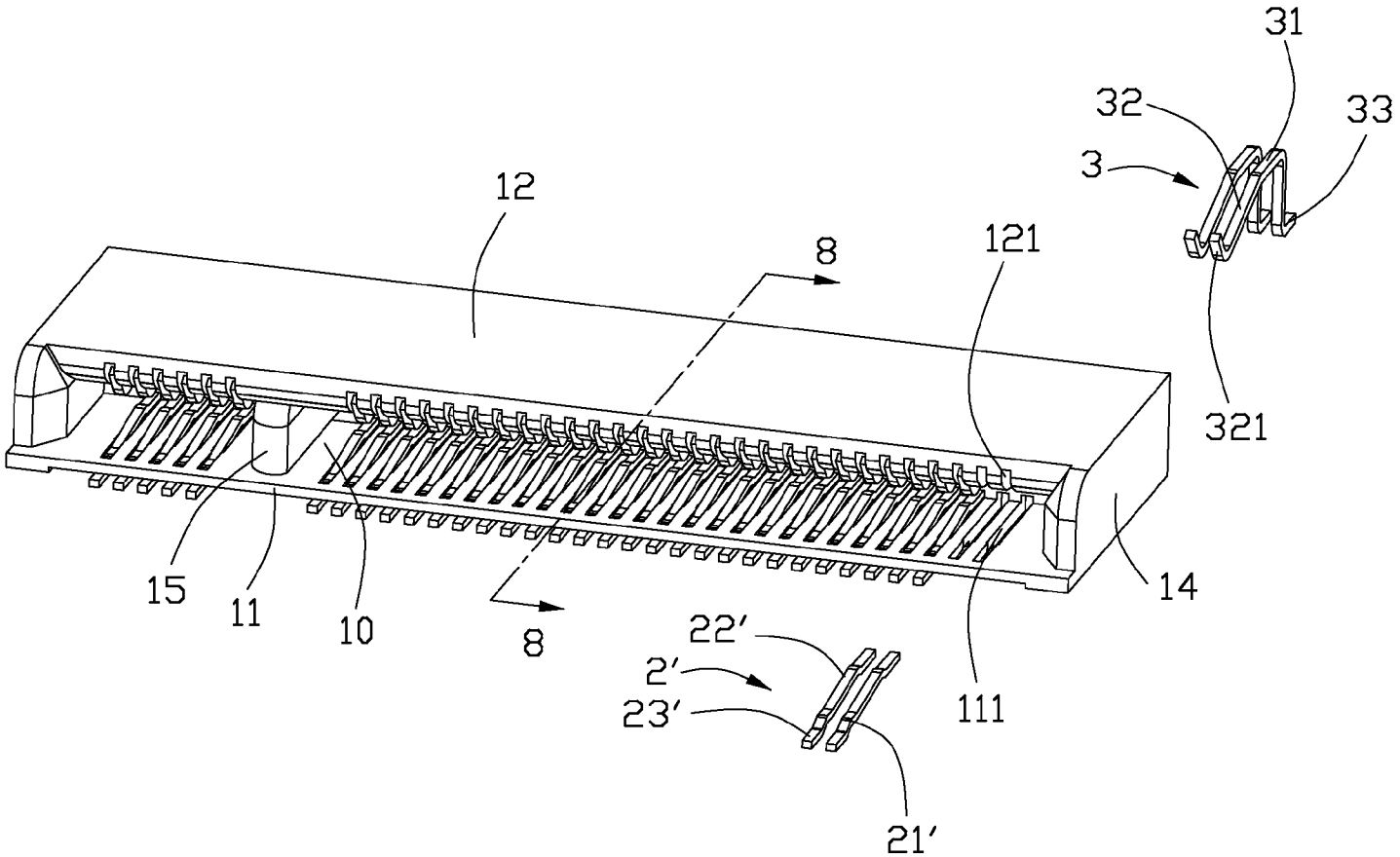
FIG. 7 is an exploded perspective view of a card edge connector in the second embodiment.
Figure 8:
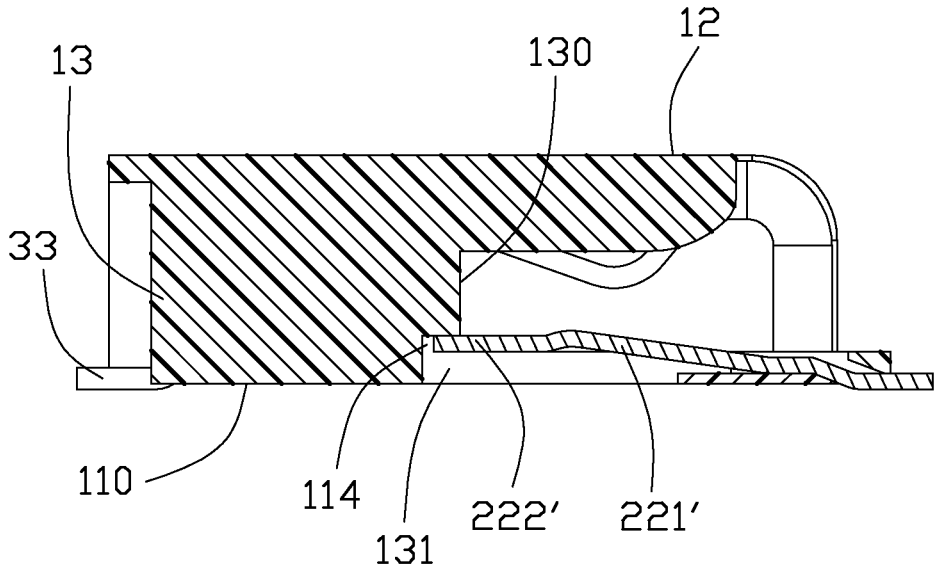
FIG. 8 is a sectional view of the card edge connector along line 8-8 shown in FIG. 7.

Referring to FIGS. 7 to 8 illustrate a card edge connector in a second embodiment, and other components expect the second terminals 2' are same as that describe in the first embodiment.

The first wall 11, the second wall 12 and the rear wall 13 surrounds the central slot 10 to provide the inner surface 130 of the central slot 10 together. The first wall 11 has a mounting surface 110 opposite to the inner surface 130 at a bottom portion thereof, the first wall 11 and the second wall 12 are located on opposite sides of the central slot 10, respectively. The inner surface of the rear wall 13 defines a notch 131 to form an abutting surface 114 facing to the first wall 11, the first terminal slot 111 rearwardly extends to form the notch 131 in the rear wall 13, and the notch 131 aligns with the first terminal slot 111 and further to nm through mounting surface 110. The first terminal 2' defines a first retaining portion 21' received in the insulative housing 1, a first contacting arm 22' extending rearwardly from the first retaining portion 21' and a first soldering portion 23' extending forwardly from the first retaining portion 21'. The first contacting arm 22' has a first contacting portion 221' projecting into the central slot 10 and a pre-pressing portion 222' extending horizontally into the notch 131 from the first contacting portion 221'. The pre-pressing portion 222' is pressed against the abutting surface 114 so that the first contacting arm 22' of the first terminal 2' has a certain pre-pressure and is elastically deformed. Therefore, even if the height of the connector is reduced, the contacting portion will have sufficient resilience to ensure a stable retention between the first terminal and the electrical card. The pre-pressing portion 222' is pressed by the abutting surface 114 which can make the first contacting arm 22' be protected by the rear wall of the insulative housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector, comprising:

an insulative housing defining a central slot extending along a longitudinal direction thereof and running through a front face thereof, a first wall and a second wall located on the opposite sides of the central slot and a rear wall connecting the first and second walls, the first wall defining an inner surface facing to the central slot, a mounting surface opposite to the inner surface and a plurality of first terminal slots arranged along the longitudinal direction and running through the inner surface and the mounting surface, the second wall defining a plurality of second terminal slots arranged along the longitudinal direction;

a plurality of first terminals received in the first terminal slots and including first retaining portions retained in the first terminal slot;

a plurality of second terminals received in the second terminal slots; wherein the mounting surface defines a recess corresponding to and close to the first retaining portions, and a longitudinal plastic sheet is received in recess and melted to fix the first retaining portions to the first wall;

the plurality of the first terminal extending rearwardly from the lower retaining portion;

the inner surface of the rear wall defines a notch to form an abutting surface facing to the first wall, the first terminal slot rearwardly extends to form the notch in the rear wall, and the notch aligns with the first terminal slot and further to run through mounting surface, the notch restricts the movement of the first terminal, not to excessed too far into the central slot.

2. The card edge connector as described in claim 1, wherein the first contacting arm has a pre-pressing portion, the inner surface defines a notch to form an abutting surface facing to the first wall, the pre-pressing portion of the first contacting arm is extending horizontally into the notch and elastically pressed against the abutting surface.

3. The card edge connector as described in claim 2, wherein the notch is formed by the first terminal slot extending rearwardly and aligned with the first terminal slot, the pre-pressing portion of the first contacting arm is located on an end of the first contacting arm.

4. The card edge connector as described in claim 1, wherein the second terminal slot communicates with the central slot and runs through the rear wall to form fixing slots on the rear wall, the second terminal defines a second retaining portion retained in the fixing slot, a second contacting arm extending forward from the second retaining portion and a second soldering portion extending rearwardly from the second retaining portion.

5. The card edge connector as described in claim 4, wherein the second contacting arm defines a resilient second contacting portion projecting into the central slot, the second soldering portion rearwardly extends outside of the insulative housing and horizontally located on a motherboard.

6. The card edge connector as described in claim 5, wherein a total thickness of the card edge connector is not more than 2.25 mm.

7. The card edge connector as described in claim 1, wherein the first terminal defines a first soldering portion extending forwardly from the first retaining portion and a resilient first contacting arm extending rearwardly from the first retaining portion, the first contacting arm has a contacting portion projecting into the central slot.

8. The card edge connector as described in claim 7, wherein width of the first retaining portion is greater than width of the first contacting portion, the retaining portion is assembled into the first terminal slot from the mounting surface to engage with opposite inner walls of the first terminal slot.

9. The card edge connector as described in claim 7, wherein each first terminal slot defines a projecting portion at a front portion thereof, the retaining portion is assembled into the first terminal slot from the mounting surface to engage with the projecting portion.

10. The card edge connector as described in claim 9, wherein the first and second terminal slots are located on opposite sides of the central slot and offset from each other in the longitudinal direction.

11. A card edge connector, comprising:

an insulative housing defining a central slot extending forwardly, a first wall and a second wall located on the opposite sides of the central slot and a rear wall connecting with the first and second walls, said three walls surrounding the central slot and commonly providing an inner surface of the central slot, the first wall defining a plurality of first terminal slots and the second wall defining a plurality of second terminal slots;

a plurality of first terminals received in the first terminal slots and including first contacting arms extending into the central slot;

a plurality of second terminals received in the second terminal slots; wherein the first contacting arm has a pre-pressing portion, the rear wall provides a notch to form an abutting surface in the inner surface facing to the first wall, the pre-pressing portion of the first contacting arm extends into the notch and elastically pressed against the abutting surface;

the plurality of the first terminal extending rearwardly from the lower retaining portion;

the inner surface of the rear wall defines a notch to form an abutting surface facing to the first wall, the first terminal slot rearwardly extends to form the notch in the rear wall, and the notch aligns with the first terminal slot and further to run through mounting surface, the notch restricts the movement of the first terminal, not to excessed too far into the central slot.

12. The card edge connector as claimed in claim 11, wherein the notch communicates downwardly with an exterior, and the abutting surface faces downwardly.

13. The card edge connector as claimed in claim 11, wherein the first terminal slots are configured to be originally open downwardly to an exterior and the corresponding first terminals are upwardly inserted into the corresponding first terminal slots respectively, and a plastic sheet attached to the housing and covering portions of the first terminals.

14. The card edge connector as claimed in claim 13, wherein a tail section of each of said first terminals is imposed thereon by a downward force derived from the housing and an upward force derived from the plastic sheel.

15. A card edge connector comprising:

an insulative elongated housing defining central slot in a longitudinal direction;

a plurality of lower passageways formed in a lower portion of the housing along said longitudinal direction and located below the central slot, each of said lower passageways extending in a front-to-back direction perpendicular to said longitudinal direction and communicating downwardly with an exterior in a vertical direction perpendicular to both said longitudinal direction and said front-to-back direction;

a plurality of lower terminals disposed in the corresponding lower passageways, respectively, each of said lower terminals being configured to be upwardly assembled into the corresponding lower passageway from a bottom side of the housing; and a plastic sheet upwardly attached to the bottom side of the housing to cover a portion of each lower passageway and that of corresponding lower terminal therein after the lower terminals are all assembled into the corresponding lower passageways; wherein each of said lower terminals defines an inner contacting section upwardly extending into the central slot for contacting a module received in the central slot, an outer tail section extending outwardly and forwardly beyond a front edge of the housing for soldering upon a printed circuit board, and a middle retention section between said inner contacting section and the outer tail section to retain the lower terminal in position with regard to the housing; wherein said plastic sheet upwardly abutting against the middle retention sections so as to prevent downward withdrawal of the lower terminals from the corresponding lower passageways, respectively;

a plurality of the lower terminal extending forwardly from the lower retaining portion and the plurality of the lower terminal extending rearwardly from the lower retaining portion;

the inner surface of the rear wall defines a notch to form an abutting surface facing to the lower wall, the lower terminal slot rearwardly extends to form the notch in the rear wall, and the notch aligns with the lower terminal slot and further to run through mounting surface, the notch restricts the movement of the lower terminal, not to excessed too far into the central slot.

16. The card edge connector as claimed in claim 15, wherein a front end of each of the lower passageways is terminated horizontally before reaching the front edge of the housing but extending downwardly and obliquely to reach the exterior.

17. The card edge connector as claimed in claim 15, wherein each of the lower terminals is essentially deemed sandwiched between the plastic sheet and the housing.

18. The card edge connector as claimed in claim 15, wherein a bottom face of the tail section is lower than that of the housing.

19. The card edge connector as claimed in claim 15, wherein a tip of the contacting section of each of the lower terminals upwardly abuts against the housing in a preloaded manner rather than a cantilevered manner.

20. The card edge connector as claimed in claim 19, wherein the housing defines a plurality of notches communicatively located in front of the corresponding lower passage-way to receive said tip therein in an up-and-down moveable manner.

* * * * *